US007980441B2

(12) United States Patent
Dittrich et al.

(10) Patent No.: US 7,980,441 B2
(45) Date of Patent: Jul. 19, 2011

(54) SETTING TOOL

(75) Inventors: Tilo Dittrich, Feldkirch (AT); Harald Fielitz, Buchs (CH); Roland Schneider, Dresden (DE); Dierk Tille, Feldkirch (AT)

(73) Assignee: Hilti Aktiengellschaft, Schaan (LI)

( * ) Notice: Subject to any disclaimer, the term of this patent is extended or adjusted under 35 U.S.C. 154(b) by 198 days.

(21) Appl. No.: 12/383,786

(22) Filed: Mar. 25, 2009

(65) Prior Publication Data

US 2009/0242608 A1 Oct. 1, 2009

(30) Foreign Application Priority Data

Mar. 26, 2008 (DE) ..... 10 2008 000 835

(51) Int. Cl.
*B25C 1/08* (2006.01)

(52) U.S. Cl. ..... 227/120; 227/9; 227/10; 227/11

(58) Field of Classification Search ..... 227/1, 9, 227/10, 109, 119, 122
See application file for complete search history.

(56) References Cited

U.S. PATENT DOCUMENTS 3,840,165 A 10/1974 Howard
3,891,133 A * 6/1975 Maier et al. ..... 227/10
4,597,517 A * 7/1986 Wagdy ..... 227/8
2006/0102683 A1 5/2006 Schnell

* cited by examiner

*Primary Examiner* — Rinaldi Rada
*Assistant Examiner* — Nathaniel Chukwurah
(74) *Attorney, Agent, or Firm* — Abelman, Frayne & Schwab

(57) ABSTRACT

A setting tool for driving fastening elements in a constructional component, includes a muzzle (14), a bolt guide (15) located in the muzzle (14), a magazine (20) for fastening elements (50) and releasably mountable on the tool housing (11) and having a connection section (21) provided at an end of the magazine (20) adjacent to the muzzle (14) and with which the magazine (20) is secured to the muzzle (14), and a connection device for releasably mounting the magazine on the tool housing (11) and including a hinge bearing formed as a plug-in coupling and provided with a first support element arranged on the connection section (21) of the magazine (20) and a second support element arranged on the muzzle (14), with the hinge bearing (17) having a pivot axis (S) provided on a side of the magazine (20) remote from the housing (11), outside of the magazine (20) and outside of the muzzle (14) and extending at a right angle to a plane (E) defined by the bolt guide (15) and the magazine (20).

6 Claims, 3 Drawing Sheets

SETTING TOOL

BACKGROUND OF THE INVENTION

1. Field of the Invention

The present invention relates to a setting tool for driving fastening elements in a constructional component and including a housing, a guide located in the housing, a drive member displaceable in the guide, a muzzle, a bolt guide located in the muzzle, a magazine for fastening elements and releasably mountable on the housing and having a connection section provided at an end of the magazine adjacent to the muzzle and with which the magazine is secured to the muzzle, and connection means located between the muzzle and the magazine and including a hinge bearing provided with first support means arranged on the connection section of the magazine and second support means arranged on the muzzle.

2. Description of the Prior Art

The setting tools of the type described above can be driven with solid, gaseous, or liquid fuels, compressed air or electrical energy.

In this setting tool, in which the drive member such as setting piston or ram drives a fastening element in a constructional component, the drive member is accelerated in the direction toward the fastening element. In combustion-operated setting tools, the drive member is driven, e.g., by combustion gases. The drive member is accelerated in a direction of a fastening element by pressure of the expanding combustion gases acting on the drive member. The drive member drives the fastening element in the constructional component. The fastening elements are usually stored in a magazine provided in the region of the muzzle of the setting tool.

U.S. Pat. No. 6,880,739 discloses a hand-held setting tool having a drive member for driving in fastening elements, with a magazine for fastening elements projecting sidewise from the muzzle. The magazine is releasably mounted on the setting tool and is secured to the muzzle by first connection means in form of screw connection means, and to tool housing in the region of the handle, by second connection means likewise in form of screw connection means. The first connection means, which is provided between the muzzle and the magazine is formed as a hinge bearing with a first support element provided on the magazine, and a second support element provided on the muzzle, with two support elements being connected with each other by a screw.

The drawback of the setting tool, which is disclosed in U.S. Pat. No. 6,880,739, consists in increased costs associated with the mounting of the magazine on the setting tool.

German Publication DE 33 37 278 A1 discloses a setting tool with a drive member for driving fastening elements and including a magazine mounted on the housing in the region of the muzzle and which pivots about a pivot points against a biasing force of a spring.

The drawback of this pivotal arrangement of the magazine on the setting tool housing consists in that an undesirable penetration of dirt in the magazine becomes possible. The dirt, which penetrates the magazine, can adversely affect the transportation of the fastening elements therein. In addition, the costs, which are associated with mounting of the magazine on the setting tool housing, are noticeably increased.

Accordingly, an object of the present invention is a setting tool of the type described above and in which the drawbacks, which are described above, are eliminated.

Another object of the present invention is a setting tool with an easy mounting of a magazine on the tool.

SUMMARY OF THE INVENTION

These and other objects of the present invention, which will become apparent hereinafter, are achieved by providing a setting tool of the type discussed above and in which the hinge bearing is formed as a plug-in coupling and has a pivot axis provided on a side of the magazine remote from the housing, outside of the magazine and outside of the muzzle and extending at a right angel to a plane defined by the bolt guide and the magazine.

The novel features of the present invention permit to mount or to secure the magazine on the muzzle by a simple plug-in or push-in movement of both support means toward each other, without a need in any screw. On the other hand, in view of the position of the pivot axis of the hinge bearing, the magazine can be pivoted on the muzzle collision-free within a limited space. With a tight mounting of the magazine on the muzzle, penetration of dirt into the magazine becomes more difficult.

Advantageously, the first support means is formed as a curved support surface provided on the connection section of the magazine, and the second support means is formed as a complementary curved counter-support surface provided on the muzzle. The curved support surface and the curved counter-support surface are brought in engagement with each other to form a plug-in coupling. Preferably, the radius of the curved support surface and the radius of the curved counter-support surface are the same. Thereby, a simple positioning of both bearing sections over each other and, thus, of the magazine on the muzzle, and an easy pivoting during the pivotal process become possible. Further, the support and counter-support surfaces can be formed relatively large. Thereby, the impact loads and surface pressure are reduced, preventing separation of the support surfaces.

According to a further advantageous embodiment of the invention, the support surface of the hinge bearing is concave, and the counter-support surface is convex. Thereby, upon mounting of the magazine on the muzzle, pivoting the magazine toward the housing is possible.

Optimal dimensions of the hinge bearing are achieved when the support surface and the counter-support surface span, respectively, an arcuate angle from minimum 25° to maximum 185°.

It is further advantageous when there is provided further connection means between the magazine and the housing and which is formed as snap connection means having a slide displaceable along a longitudinal extent of the magazine (and provided on a one of portions of the magazine and the housing) and carrying a snap member that cooperates with a counter-snap member (provided on another of portions of the magazine and the housing). There is further provided at least one elastic element for biasing the slide. The slide biases, in its biased position, the magazine against the muzzle in the snap position of the magazine. The snap connection means permits attachment of the magazine to the housing in a simple manner in addition to the hinge bearing because the snap connection automatically snaps in when the magazine is pressed against the housing of the setting tool, whereby the magazine becomes connected with the setting tool housing. Simultaneously, with the magazine being pressed against the muzzle or the bolt guide, which is provided in the muzzle, a tight connection of the muzzle or the bolt guide on one hand, and the connection section of the magazine, on the other hand, is provided. The seam between the magazine and the muzzle is tightly closed.

It is further advantageous when the slide is provided on the magazine and is biased by the elastic element in a direction away from the connection section. The snap member is provided at an end of the slide remote from the connection section and adjacent to the housing, and the counter-snap member is provided on the housing. This provides for a simple two-hand operation during detachment of the magazines from the setting tool. The tool operator holds the setting tool in one hand and the magazine in another hand and simultaneously displaces the slide, opening the snap connection.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
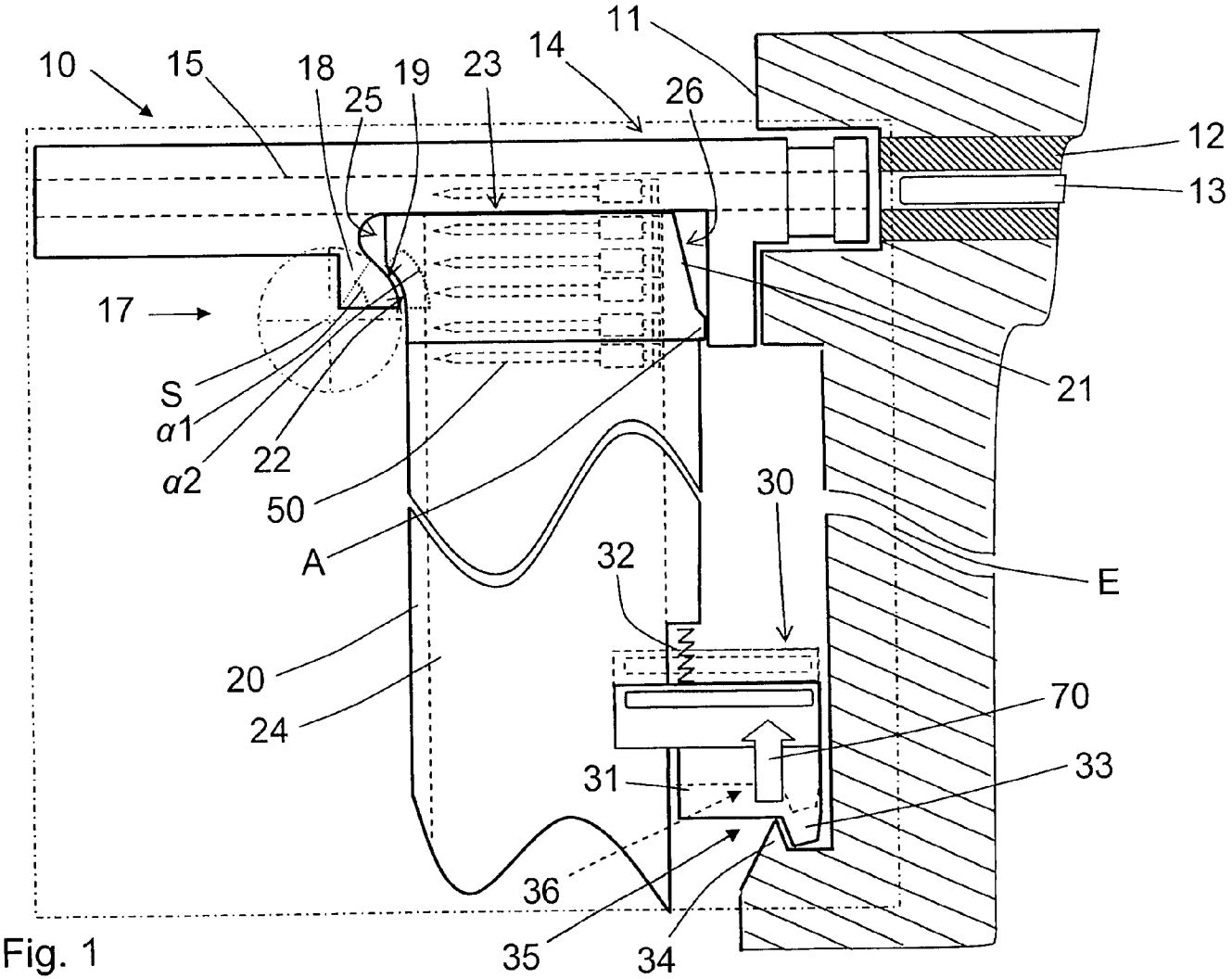
FIG. 1 a partially cross-sectional view of a muzzle region of a setting tool according to the present invention with a magazine for fastening elements.
Figure 2:
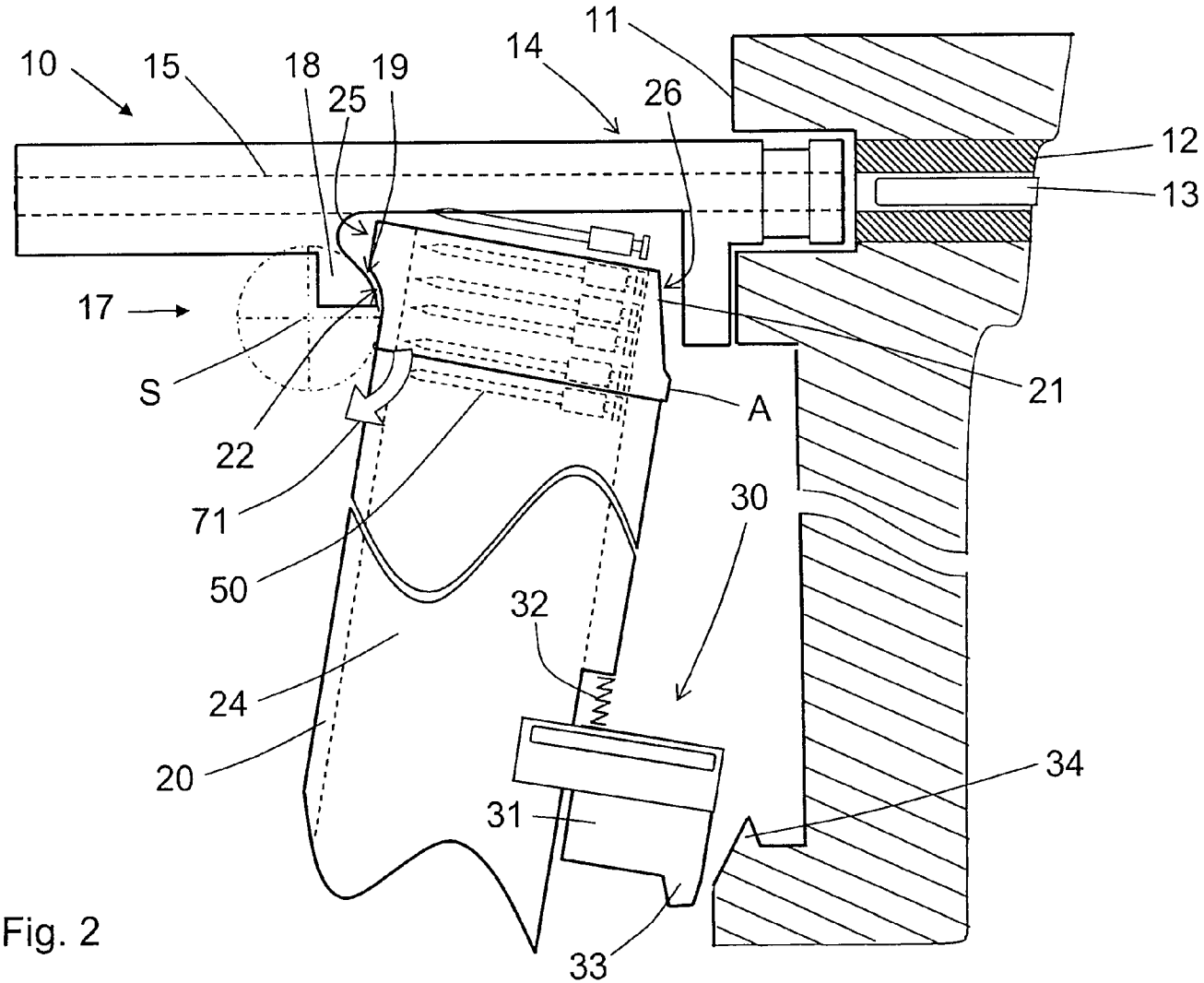
FIG. 2 a partially cross-sectional view of the muzzle region shown in FIG. 1 with the magazine for fastening elements in a partially detached, from the housing of the setting tool, position.
Figure 3:
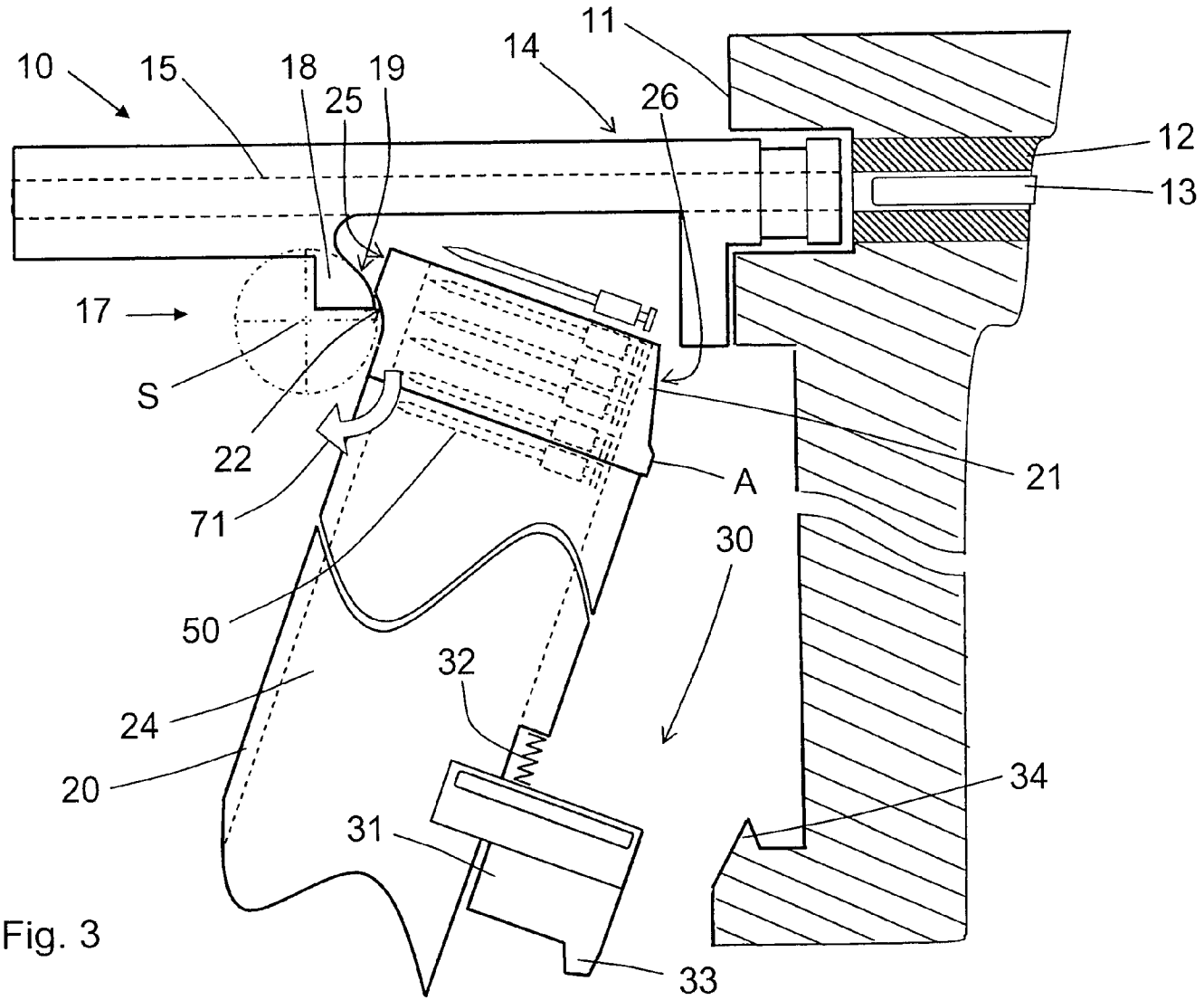
FIG. 3 a partially cross-sectional view of the muzzle region shown in FIG. 1 with the magazine for fastening elements in a completely detached, from the muzzle and the housing of the setting tool, position.

FIGS. 1 through 3 show a muzzle region of a hand-held setting tool 10 according to the present invention. The setting tool 10 can be formed as an electrically or combustion-operated power tool and includes a setting mechanism located in the tool housing 11. The setting mechanism includes a drive member 13 that is formed as a setting piston and is displaceable in a guide 12. In FIGS. 1 through 3, the drive member 13 is shown in its initial position in which the drive member 13 is ready for a setting process.

The setting tool 10 is provided with a bolt guide 15 that is arranged in the muzzle 14 of the setting tool 10. The bolt guide 15 extends coaxially with the guide 12 for the drive member 13. The muzzle 14 is placeable with its free end, remote from the housing 11, against a workpiece. The bolt guide 15 serves for receiving and guiding fastening elements 50 (shown in FIG. 1) and for guiding a fastening element-driving end of the drive member 13. A fastening element 50, which is located in the bolt guide 15, is driven, during a setting process, in a workpiece (not shown) by the drive member 13 movable in the direction of the free end of the bolt guide 15.

Sidewise of the muzzle 14, a magazine for fastening elements 50, which is generally designated with a reference numeral 20, projects. The magazine 20 is releasably mounted on the setting tool 10. In the magazine 20, there is provided a guide channel 24 for fastening elements 50 and which is open toward the bolt guide 15, which makes the transportation of the fastening elements 50 from the guide channel 24 into the bolt guide 15 possible in the mounted position of the magazine 20 shown in FIG. 1 when the magazine 20 is secured to the housing 11. At its end adjacent to the muzzle 14, the magazine 20 has a connection section 21 which is formed as a connection member. The first narrow side 25 of the connection section 21 has a concave support surface 22 that forms, together with a convex counter-support surface 19, which is provided on a mounting section 18 of the muzzle 14, a pivot coupling in form of a hinge bearing 17. The hinge bearing 17 forms releasable connection means in form of a plug-in coupling. A pivot axis S of the hinge bearing 17 is located outside of the muzzle 14 and outside of the magazine 20 and at a right angle to a plane E defined by the bolt guide 15 and the magazine 20. The concave support surface 22 and the convex support surface 19 are formed complementary to each other and provide for an arcuate angle $\alpha 1$, $\alpha 2$ of minimum 25° to maximum 185° (see FIG. 1), which insures an optimal guidance of the two surfaces relative to each other. The hinge bearing 17 is arranged on a side of magazine 20 remote from the housing 11 of the setting tool 10.

The hinge bearing 17 supports the magazine 20 against the muzzle 14 in the drive-in direction of the drive member 13 and in a direction transverse to the longitudinal extent of the bolt guide 15.

Opposite the narrow side 25 of the connection section 21 and the magazine 20 with its concave support surface 22, a second narrow side 26 of the connection section 21 and the magazine 20 are arranged. On the second narrow side 26, a stop A is provided in the region of the connection section 21. The stop A engages an edge of the muzzle 14 in an attached position of the magazine 20. The stop A supports the magazine 20 against the muzzle 14 in a direction opposite the drive-in direction of the drive member 13. On the second narrow side 26, in the region of the magazine body itself, there is provided a slide 31 of a snap connection (as further connection means) generally designated with a reference numeral 30. The slide 31 is displaceable, within certain limits, along a longitudinal extent of the magazine 20. The slide 31 is biased in a direction away from the connection section 21 of the magazine 20 by at least one elastic element 32 such as, e.g., a spring. The slide 31 has, in its end region remote from the connection section 21 of the magazine 20, at least one snap element 33 that is brought in engagement with a counter-snap element 34 of the snap connection 30 and which is provided on the housing 11 of the setting tool 10, in the snap position 35 shown in FIG. 1. In the snap position 35, the magazine 20 is reliably secured on the setting tool 10 by the hinge bearing 17 in combination with the snap connection 30. The biased slide 31 biases or presses the magazine 20 in a direction transverse to the bolt guide 15, toward the bolt guide 15 or the muzzle 14. As a result, a seam 23 between the muzzle 14 or the bolt guide 15, on one hand, and the connection section 21 of the magazine 20, on the other hand, is tightly closed. In this position, in which the magazine 20 is secured to the muzzle 14, no particles can penetrate through the opening of the guide channel 24 in the magazine 20 and in the bolt guide 15 that is open toward the magazine 20.

In order to detach the magazine 20 from the muzzle 14, the slide 31 is displaced manually against the biasing force of the at least one elastic element 32 in the direction of the arrow 70 into a release position 36 in which the slide 31 is shown in FIG. 1 with dash lines. With this release of the snap connection between the snap member 33 and the counter-snap member 34, the magazine 20 can be pivoted about the hinge bearing 17 with a virtual pivot axis S, which is located outside of the muzzle 14 and outside the magazine 20, only in the direction of the pivot arrow 71 (see FIGS. 2 and 3) until the magazine 20 is completely detached from the muzzle part 14 and becomes free. For mounting the magazine 20, this process is carried out in the opposite direction until the snap connection 30 becomes closed and the snap member 33 engages in the counter-snap element 34.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A setting tool for driving fastening elements in a constructional component, comprising a housing (11); a guide (12) located in the housing (11); a drive member (13) displaceable in the guide (12); a muzzle (14); a bolt guide (15) located in the muzzle (14); a magazine (20) for fastening elements (50) and releasably mountable on the housing (11) and having a connection section (21) provided at an end of the magazine (20) adjacent to the muzzle (14) and with which the magazine (20) is secured to the muzzle (14); and connection means for releasably mounting the magazine (20) on the housing (11) and located between the muzzle (14) and the magazine, the connection means having a hinge bearing (17) provided with first support means arranged on the connection section (21) of the magazine (20) and second support means arranged on the muzzle (14), the hinge bearing (17) being formed as a plug-in coupling and having a pivot axis (S) provided on a side of the magazine (20) remote from the housing (11), outside of the magazine (20) and outside of the muzzle (14) and extending at a right angle to a plane (E) defined by the bolt guide (15) and the magazine (20), the magazine pivoting about the pivot axis (S) between a first position in which the magazine (20) is fixedly secured to the muzzle (14), and a second position in which the magazine (20) is detached from the muzzle (14).

2. A setting tool according to claim 1, wherein the first support means is formed as a curved support surface (22) provided on the connection section (21) of the magazine (20), and the second support means is formed as a complementary curved counter-support surface (19) provided on the muzzle (14), the cooperating curved support surface (21) and the curved counter-support surface (19) engaging each other to form a plug-in coupling.

3. A setting tool according to claim 2, wherein the support surface (22) is concave, and the counter-support surface (19) is convex.

4. A setting tool according to claim 2, wherein the support surface (22) and the counter-support surface (19) span, respectively, an arcuate angle ($\alpha 1$, $\alpha 2$) from minimum 25° to maximum 185°.

5. A setting tool for driving fastening elements in a constructional component, comprising a housing (11); a guide (12) located in the housing (11); a drive member (13) displaceable in the guide (12); a muzzle (14); a bolt guide (15) located in the muzzle (14); a magazine (20) for fastening elements (50) and releasably mountable on the housing (11) and having a connection section (21) provided at an end of the magazine (20) adjacent to the muzzle (14) and with which the magazine (20) is secured to the muzzle (14); connection means for releasably mounting the magazine (20) on the housing (11) and located between the muzzle (14) and the magazine, the connection means having a hinge bearing (17) provided with first support means arranged on the connection section (21) of the magazine (20) and second support means arranged on the muzzle (14), the hinge bearing (17) being formed as a plug-in coupling and having a pivot axis (S) provided on a side of the magazine (20) remote from the housing (11), and having snap-in means (30) including a slide (31) displaceable along a longitudinal extent of the magazine (20) and carrying a snap member (33) that cooperates with a counter-snap member (34), and at least one elastic element (32) for biasing the slide (31), and wherein the slide (31) biases, in a biased position thereof, the magazine (20).

6. A setting tool according to claim 5, wherein the slide (31) is provided on the magazine (20) and is biased by the elastic element (32) in a direction away from the connection section (21), and wherein the snap member (33) is provided at an end of the slide (31) remote from the connection section (21) and adjacent to the housing (11), and the counter-snap member (34) is provided on the housing (11).

* * * * *